US010743647B2

(12) United States Patent
Xi et al.

(10) Patent No.: US 10,743,647 B2
(45) Date of Patent: Aug. 18, 2020

(54) ORAL CARE IMPLEMENT AND MONOFILAMENT BRISTLE FOR USE WITH THE SAME

(71) Applicant: Colgate-Palmolive Company, New York, NY (US)

(72) Inventors: Wen Jin Xi, Shanghai (CN); Bo Zhang, Yangzhou (CN); Yu Liu, Wuxi (CN)

(73) Assignee: Colgate-Palmolive Company, New York, NY (US)

( * ) Notice: Subject to any disclaimer, the term of this patent is extended or adjusted under 35 U.S.C. 154(b) by 221 days.

(21) Appl. No.: 15/742,163

(22) PCT Filed: Jul. 7, 2015

(86) PCT No.: PCT/CN2015/083481
§ 371 (c)(1),
(2) Date: Jan. 5, 2018

(87) PCT Pub. No.: WO2017/004792
PCT Pub. Date: Jan. 12, 2017

(65) Prior Publication Data

US 2018/0206627 A1 Jul. 26, 2018

(51) Int. Cl.
*A46B 9/04* (2006.01)
*A46D 1/00* (2006.01)

(52) U.S. Cl.
CPC ..... *A46B 9/04* (2013.01); *A46D 1/023* (2013.01); *A46D 1/0207* (2013.01);
(Continued)

(58) Field of Classification Search
CPC .... A46D 1/0207; A46D 1/023; A46D 1/0238; A46D 1/0292; A46B 9/04
(Continued)

(56) References Cited

U.S. PATENT DOCUMENTS 3,258,805 A * 7/1966 Rossnan ..... A46B 15/0075 15/110
3,295,156 A 1/1967 Brant
(Continued)

FOREIGN PATENT DOCUMENTS

CA 2560512 C 7/2009
CN 1500163 5/2004
(Continued)

OTHER PUBLICATIONS

International Search Report and Written Opinion of the International Searching Authority in International Application No. PCT/CN2015/083481, datd Mar. 23, 2016.
(Continued)

*Primary Examiner* — Randall E Chin

(57) ABSTRACT

A monofilament bristle (211) including: a body portion (215); a tip portion (217) extending from the body portion (215) and comprising a multi-lobed transverse cross-section (221), the monofilament bristle (211) extending along a longitudinal axis (219); co-extruded first and second components, the first component being a first color and forming a first lobe (223*a*) of the multi-lobed transverse cross-section (221), the second component being a second color, which is different from the first color, and forming a second lobe (223*b*) of the multi-lobed transverse cross-section (221); and each of the first and second components forming a longitudinal section of the body portion (215), with an interface between the first and second components extending substantially parallel to the longitudinal axis (219).

5 Claims, 10 Drawing Sheets

(52) U.S. Cl.
CPC ..... *A46D 1/0238* (2013.01); *A46D 1/0292* (2013.01); *A46B 2200/1066* (2013.01)

(58) Field of Classification Search
USPC ..... 15/207.2
See application file for complete search history.

(56) References Cited

U.S. PATENT DOCUMENTS

| | | | | |
|---|---|---|---|---|
| 4,279,053 | A | 7/1981 | Payne et al. | |
| 5,128,208 | A | 7/1992 | Bond et al. | |
| 5,690,913 | A | 11/1997 | Hsu et al. | |
| 5,933,906 | A | 8/1999 | Rackley | |
| 6,311,359 | B1 | 11/2001 | Brezler, III | |
| 6,391,240 | B1 | 5/2002 | Rackley | |
| 6,412,139 | B1 | 7/2002 | Weihrauch | |
| 6,506,327 | B2 | 1/2003 | Weihrauch | |
| 6,871,373 | B2 | 3/2005 | Driesen et al. | |
| 8,297,710 | B2 | 10/2012 | Sakurai et al. | |
| 8,448,286 | B2 | 5/2013 | Driesen et al. | |
| 9,578,957 | B2 | 2/2017 | Patel et al. | |
| 2003/0080463 | A1* | 5/2003 | Harris | A46D 1/023 264/178 F |
| 2004/0091704 | A1 | 5/2004 | Weihrauch et al. | |
| 2004/0103492 | A1 | 6/2004 | Kwon et al. | |
| 2006/0236478 | A1 | 10/2006 | Hohlbein et al. | |
| 2009/0013488 | A1 | 1/2009 | Sakurai et al. | |
| 2010/0293734 | A1 | 11/2010 | Driesen et al. | |
| 2012/0091784 | A1 | 4/2012 | Sakurai et al. | |

FOREIGN PATENT DOCUMENTS

| | | | |
|---|---|---|---|
| CN | 1900402 | A | 1/2007 |
| CN | 203609001 | U | 5/2014 |
| EP | 0986656 | | 11/2004 |
| EP | 2 011 416 | A1 * | 1/2009 |
| EP | 2460437 | | 6/2012 |
| JP | 2001-169827 | | 6/2001 |
| JP | 2001-169829 | | 6/2001 |
| JP | 2003-339445 | | 12/2003 |
| JP | 3547672 | | 7/2004 |
| JP | 2006-255068 | A | 9/2006 |
| JP | 2007-244546 | | 9/2007 |
| JP | 2010-082094 | | 4/2010 |
| JP | 2011-125583 | A | 6/2011 |
| WO | WO 2002/077334 | | 10/2002 |
| WO | 2007/123013 | | 11/2007 |
| WO | WO 2014/050863 | | 8/2016 |

OTHER PUBLICATIONS

The DuPont Oval, 2007, "DuPont Filament for Toothbrush Filaments: DUPONT™ TYNEX® Feathered Filament" http://jingjay-huajing.com/pdf/dupont_tynex/Feathered.pdf.

* cited by examiner

ORAL CARE IMPLEMENT AND MONOFILAMENT BRISTLE FOR USE WITH THE SAME

BACKGROUND

Presently color is used in individual bristles, which are generally combined into bristle tufts of a toothbrush, to provide the user with an indicator of the wear due to use of the toothbrush. In the case of monofilament bristles, the introduction of color for purposes other than to show wear, such as for decorative purposes, can be problematic because bristles on a toothbrush tend to have a small cross sectional diameter, which for some bristles are on the order of 0.5 mm or less. Therefore, decorative color on a toothbrush tends to be created by groupings of bristles having the same coloration, or by larger tooth cleaning elements, which make it easier to introduce coloration due to the larger scale size as compared to an individual bristle.

BRIEF SUMMARY

The present invention is directed to an oral care implement having bristles with components that are combined to create decorative color combinations in individual bristles, and by extension enabling new color features within bristle tufts and on toothbrushes.

In one aspect, the invention can be a monofilament bristle comprising: a body portion; a tip portion extending from the body portion and comprising a multi-lobed transverse cross-section, the monofilament bristle extending along a longitudinal axis; co-extruded first and second components, the first component being a first color and forming a first lobe of the multi-lobed transverse cross-section, the second component being a second color, which is different from the first color, and forming a second lobe of the multi-lobed transverse cross-section; and each of the first and second components forming a longitudinal section of the body portion, with an interface between the first and second components extending substantially parallel to the longitudinal axis.

In another aspect, the invention can be a monofilament bristle comprising: a body portion; a tip portion, the at least one monofilament bristle extending along a longitudinal axis; the body portion having a multi-lobed transverse cross-section and having an outer surface that is a first color; and the tip portion comprising a plurality of tips extending axially from the body portion, at least a first one of the plurality of tips having an outer surface that is a second color, which is different from the first color.

In further aspects, the invention can be an oral care implement comprising: a handle; a head coupled to the handle; and at least one bristle tuft extending from a first surface of the head, the at least one bristle tuft comprising at least one monofilament bristle as set forth above.

In a yet further aspect, the invention can be an oral care implement comprising: a handle; a head coupled to the handle; at least one bristle tuft extending from a first surface of the head, the at least one bristle tuft comprising at least one monofilament bristle bent into a U-shape and mounted to the head so that: (1) a first leg of the monofilament bristle extends from the front surface of the head and comprises a first body portion and a first tip portion; and (2) a second leg of the monofilament bristle extends from the front surface of the head and comprises a second body portion and a second tip portion; each of the first and second body portions of the at least one monofilament bristle having a multi-lobed transverse cross-section; and the first tip portion comprising a first plurality of tips axially protruding from the first body portion.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
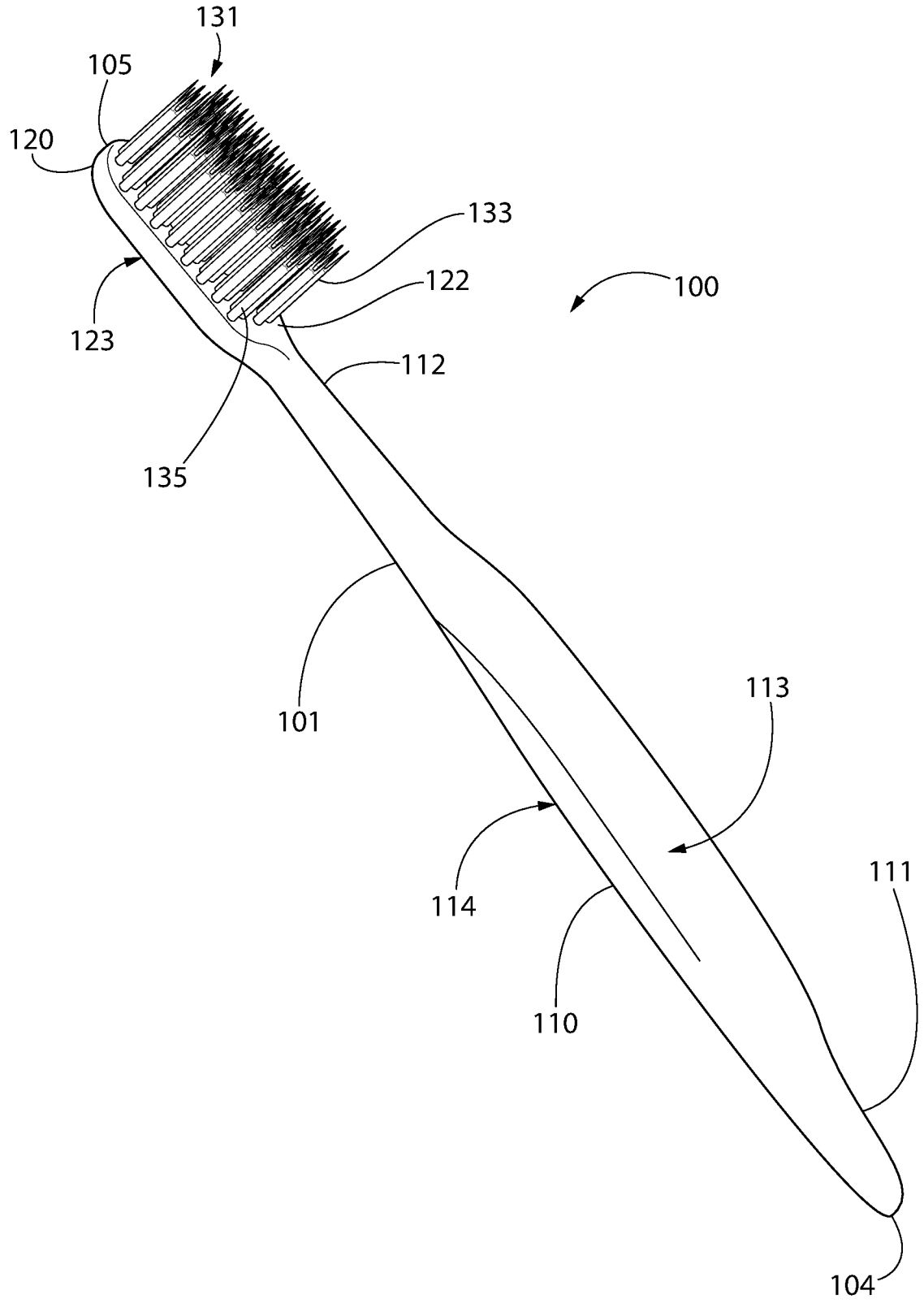
FIG. 1 is a first oral care implement in accordance with an embodiment of the invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring to FIG. 1, an oral care implement 100 is illustrated in accordance with an embodiment of the present invention. In the exemplified embodiment, the oral care implement 100 is in the form of a manual toothbrush. However, in certain other embodiments the oral care implement 100 can take on other forms such as a powered toothbrush. Thus, it is to be understood that the inventive concepts discussed herein can be applied to any type of brushing implement used for oral care, unless a specific type of oral care implement is specified in the claims.

The oral care implement 100 generally includes a body 101 comprising a handle 110 and a head 120. The body 101 generally extends from a proximal end 104 to a distal end 105. In certain embodiments, the body 101 may have a simple linear arrangement, and in certain other embodiments, the body 101 may have a non-linear structure.

The handle 110 extends from a proximal end 111 to a distal end 112 and the head 120 is coupled to the distal end 112 of the handle 110. The handle 110 is an elongated structure that provides the mechanism by which the user can hold and manipulate the oral care implement 100 during use. The handle 110 comprises a front surface 113 and an opposing rear surface 114. The handle 110 may include various contours for user comfort. In certain other embodiments the handle 110 can take on a wide variety of shapes, contours and configurations, none of which are limiting of the present invention unless so specified in the claims.

In the exemplified embodiment, the handle 110 is formed of a rigid plastic material, such as, for example without limitation, polymers and copolymers of ethylene, propylene, butadiene, vinyl compounds and polyesters such as polyethylene terephthalate. Of course, the invention is not to be so limited in all embodiments and the handle 110 may include a resilient material, such as a thermoplastic elastomer, as a grip cover that is molded over portions of or the entirety of the handle 110 to enhance the gripability of the handle 110 during use. For example, portions of the handle 110 that are typically gripped by a user's palm during use may be overmolded with a thermoplastic elastomer or other resilient material to further increase comfort to a user.

The head 120 of the oral care implement 100 is coupled to the handle 110 and comprises a front surface 122 and an opposing rear surface 123. In the exemplified embodiment, the head 120 is formed integrally with the handle 110 as a single unitary structure using a molding, milling, machining or other suitable process. However, in other embodiments the handle 110 and the head 120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. In some embodiments the head 120 may be detachable from the handle 110. The head 120 may be formed of any one of the materials discussed above with regard to the handle 110.

In the exemplified embodiment, the head 120 of the oral care implement 100 is provided with a plurality of tooth cleaning elements 131 extending from the front surface 122. Furthermore, in the exemplified embodiment the tooth cleaning elements 131 are illustrated as a plurality of bristle tufts 133, and each bristle tuft 133 is illustrated as a plurality of monofilament bristles 135. In certain embodiments the exact structure, pattern, orientation and material of the tooth cleaning elements 131 are not to be limiting of the present invention unless so specified in the claims. In certain embodiments, the tooth cleaning elements 131 may include the bristle tufts 133 along with one or more other types of tooth cleaning elements. As used herein, the term "tooth cleaning elements" is used in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

In certain embodiments, the bristle tufts 133, and other tooth cleaning elements 131, may be mounted on a head plate that forms part of the head 120 of the oral care implement 100. The head plate is formed separately and, at a later stage of the manufacturing process, is connected to the body 101 at a later stage of the manufacturing process to form the head 120. The head plate may be connected to the body 101, to form the head 120, by any suitable technique known in the art, including without limitation thermal or ultrasonic welding, any fusion techniques such as thermal fusion, melting, a tight-fit assembly, a coupling sleeve, threaded engagement, adhesion, or fasteners. In such an embodiment, the head plate may include a plurality of holes formed therethrough, with the bristle tufts 133 and any other included tooth cleaning elements 131 mounted to the head plate within the holes. This type of technique for mounting the bristle tufts 133 and other tooth cleaning elements to the head 120 via a head plate is generally known as anchor free tufting (AFT). Specifically, in AFT a plate or membrane is created separately from the head 120. The tooth cleaning elements 131 (such as the bristle tufts 133) are positioned into the head plate so as to extend through the head plate. The free ends of the other tooth cleaning elements 131 on one side of the head plate perform the cleaning function. The ends of the tooth cleaning elements 131 on the other side of the head plate are melted together by heat to be anchored in place. After the tooth cleaning elements 131 are secured to the head plate, the head plate is secured to the head 120 such as by ultrasonic welding. In certain embodiments, the portion of the bristle tufts 133 that are melted together comprise the anchor portion of the bristle tufts 133 and individual bristles.

Any suitable technique for attaching the bristle tufts 133 and other tooth cleaning elements 131 to the head may be used in the broad practice of this invention. Specifically, the tooth cleaning elements 131 of the present invention can be connected to the head 120 in any manner known in the art. For example, staples/anchors or in-mold tufting (IMT) could be used to mount the tooth cleaning elements 131. In certain embodiments, various combinations of stapled, IMT or AFT bristles may be used. Alternatively, the bristle tufts 133 may be mounted to tuft blocks by extending through suitable openings in the tuft blocks so that the base of the bristles is mounted within or below the tuft block. Such tuft blocks may then be connected to the to the body 101 to form the head 120 of the oral care implement 100.

Although not illustrated herein, in certain embodiments the head 120 may also include a soft tissue cleanser coupled to or positioned on its rear surface 123. An example of a suitable soft tissue cleanser that may be used with the present invention and positioned on the rear surface of the head 120 is disclosed in U.S. Pat. No. 7,143,462, issued Dec. 5, 2006 to the assignee of the present application, the entirety of which is hereby incorporated by reference. In certain other embodiments, the soft tissue cleanser may include protuberances, which can take the form of elongated ridges, nubs, or combinations thereof. Of course, the invention is not to be so limited and in certain embodiments the oral care implement 100 may not include any soft tissue cleanser.

Figure 2A:
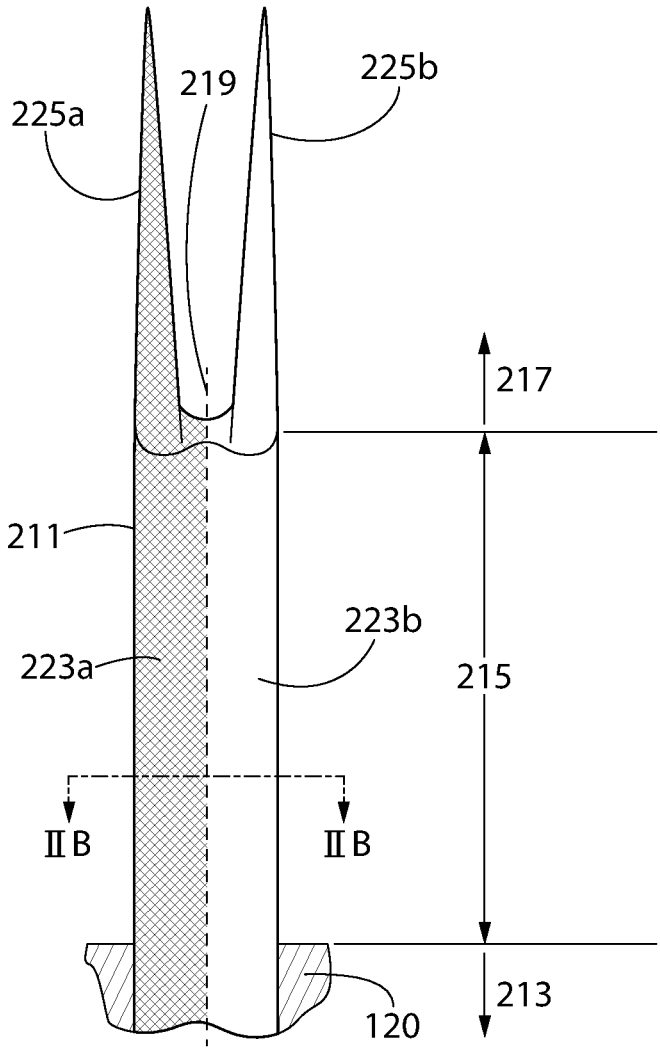
FIG. 2A illustrates a first monofilament bristle.
Figure 2B:
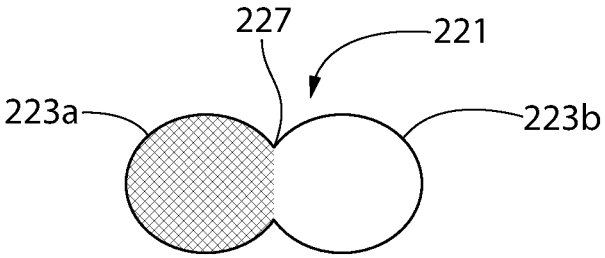
FIG. 2B illustrates a transverse cross-section of the body portion of the monofilament bristle of FIG. 2A.

Referring to both FIGS. 2A-2B, an embodiment of a monofilament bristle 211 is shown including an anchor portion 213, which extends into the head 120 and serves to anchor the monofilament bristle 211 to the head 120, a body portion 215, and a tip portion 217. The body portion 215 is located between the anchor portion 213 and the tip portion 217. The monofilament bristle 211 extends away from the head 120 along a longitudinal axis 219 and has a multi-lobed cross section 221 within at least the body portion 215, as shown in FIG. 2B. Each lobe 223*a*, 223*b* of the body portion 215 extends generally parallel to the longitudinal axis 219. In the embodiment shown in FIG. 2A, the tip portion 217 includes two tips 225*a*, 225*b*, with each tip 225*a*, 225*b* extending longitudinally from, respectively, one of the lobes 223*a*, 223*b* of the body portion 215. In certain embodiments, any one of the lobes 223*a*, 223*b* may terminate in more than one tip.

The monofilament bristle 211 may be formed by coextruding first and second components, with the first component substantially forming the first lobe 223*a* and the second component substantially forming the second lobe 223*b*. In the central region 227 of at least the body portion 215, where the lobes 223*a*, 225*b* come together, an interface is created between the first and second components, and this interface extends substantially parallel to the longitudinal axis 219. Also within the central region 227, the first component and the second component may intermingle as a result of the coextrusion process. Although the lobes shown in FIG. 2A have rounded surfaces, certain embodiments of the monofilament bristle 211 may include lobes with surfaces that are more rounded, less rounded, and even formed by a plurality of straight lines intersecting at angles.

The first and second components of the monofilament bristle 211 may be formed from a wide variety of synthetic materials which may be coextruded. Examples of materials that may be used to form the monofilament bristle 211 include, but are not limited to, nylon, aramid, and other polyamide resins, polybutylene terephthalate (PBT), polypropylene terephthalate (polytrimethylene terephthalate, PPT or PTT), or polyethylene terephthalate (PET), and other polyester resins, polypropylene (PP), polyethylene (PE) and other polyolefin resins, and other publicly known synthetic resins can be used for bristles of a toothbrush.

In certain embodiments, the tips 225*a*, 225*b* on any one end of the monofilament bristle 211 may be formed by briefly immersing an end of the monofilament bristle 211 in a bath of a chemical solution, such as a caustic soda (NaOH). When the end is removed from the bath, the tips 225*a*, 225*b* are formed, each extending from one of the lobes 223*a*, 223*b* of the monofilament bristle 211 as shown in FIG. 2A. The length of the tips 225*a*, 225*b* may be adjusted by the concentration of the chemical solution, immersing time, pulling out speed from the chemical solutions, among other factors. The tip portion 217 may generally be delineated from the body portion 215 in that the tip portion 217 is the portion of the monofilament bristle 211 that is immersed within the chemical solution.

Coloring agents may be added to one or both of the first and second components of the monofilament bristle 211. In certain embodiments, the only difference between the first and second components may be the inclusion of a coloring agent in one of the two components, while no coloring agent, or a different coloring agent, is included in the other component. The bristle tufts 133, in certain embodiments, may be formed from multiple ones of the monofilament bristles 211 that are formed to have the same coloration for both of the lobes 223*a*, 223*b*, or from monofilament bristle 211 that have a variety of coloration for both of the lobes 223*a*, 223*b*. In this way, a greater variety in the coloration of the tooth cleaning elements 131 may be obtained using such multi-colored monofilament bristles 211. For example, in certain embodiments the coloring agents may be selected so that the colors of the two lobes are contrasting or complementary, with the color of the first component being different from the color of the second component. In certain other embodiments, the coloring agents may be selected so that the colors of the lobes 223*a*, 223*b*, and the bristle tufts 133, impart sentimental meaning to the user of a toothbrush, e.g., the colors are the same as the colors used by a favorite sports team, a high school, a college, a brand (which may be a brand other than the manufacturer or seller of the toothbrush), and the like.

In certain embodiments, the first and second components may be selected to vary the translucency/opaqueness of one or both of the lobes 223*a*, 223*b*. As used herein, a component forming part of the monofilament bristle 211 is translucent when the perceived color results from at least one color of visible light substantially passes through the component. Conversely, as used herein, a component forming part of the monofilament bristle 211 is opaque when the perceived color results from at least one color of visible light reflected or scattered off the surface of the component. In certain embodiments, a component forming part of the monofilament bristle 211 may be both partially translucent and partially opaque.

Figure 3A:
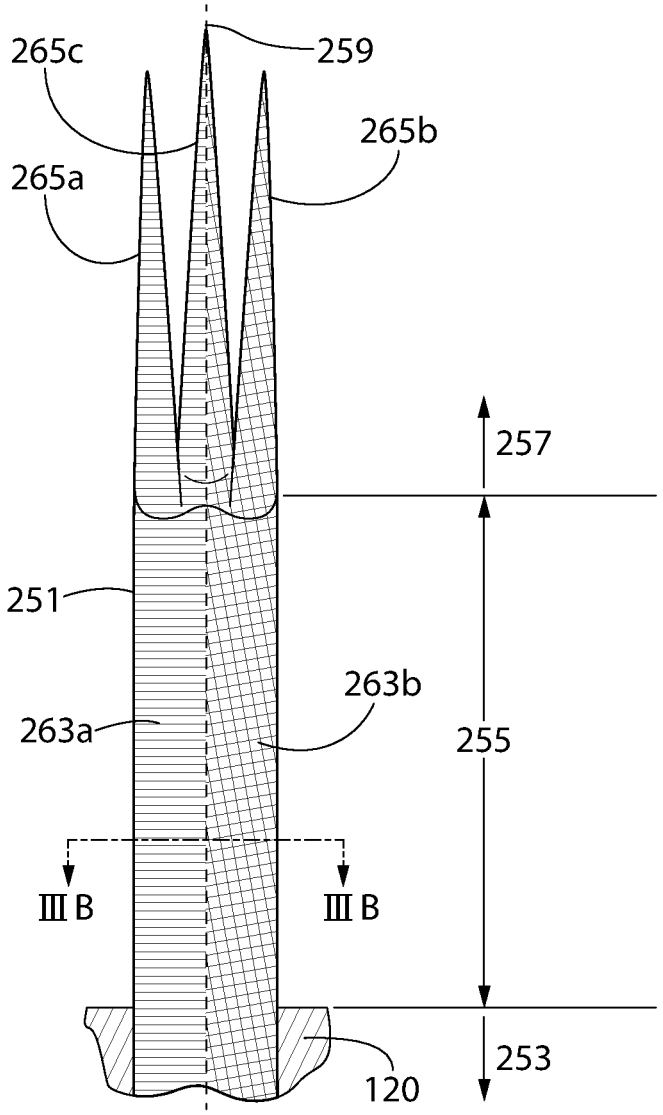
FIG. 3A illustrates a second monofilament bristle.
Figure 3B:
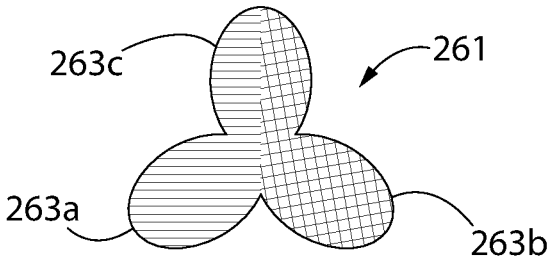
FIG. 3B illustrates a transverse cross-section of the body portion of the monofilament bristle of FIG. 3A.

Referring to both FIGS. 3A-3B, an embodiment of a monofilament bristle 251 is shown including an anchor portion 253, which extends into the head 120 and serves to anchor the monofilament bristle 251 to the head 120, a body portion 255, and a tip portion 257. The body portion 255 is located between the anchor portion 253 and the tip portion 257. The monofilament bristle 251 extends away from the head 120 along a longitudinal axis 259 and has a multi-lobed cross section 261 within at least the body portion 255, as shown in FIG. 3B. Each lobe 263*a*, 263*b*, 263*c* of the body portion 255 extends generally parallel to the longitudinal axis 259. In the embodiment shown in FIG. 3A, the tip portion 257 includes three tips 265*a*, 265*b*, 265*c*, with each tip 265*a*, 265*b*, 265*c* extending longitudinally from, respectively, one of the lobes 263*a*, 263*b*, 263*c* of the body portion 255. In certain embodiments, any one of the lobes 263*a*, 263*b*, 263*c* may terminate in more than one tip.

The monofilament bristle 251 may be formed by coextruding first and second components, with the first component substantially forming the first lobe 263*a*, the second component substantially forming the second lobe 263*b*, and a both the first component and the second component forming the third lobe 263*c*. In the central region 267 of the body portion 255, where the lobes 263*a*, 265*b* come together, and in the third lobe 263*c*, the first component and the second component may intermingle as a result of the coextrusion process. The first and second components of the monofilament bristle 251 may be coextruded as described above. In addition, the first and second components may include coloring agents and/or be selected to be translucent, opaque, or any desired combination thereof. The tips 265*a*, 265*b*, 365*c* of each lobe 263*a*, 263*b*, 263*c* may be formed in the manner described above. In the embodiment shown in FIGS. 3A-3B, with the first component and the second component being different colors, the first lobe 263*a* is the color of the first component, the second lobe 263*b* is the color of the second component, and the third lobe 263*c* is a combination of the first color and the second color.

In certain embodiments, a third component may be coextruded with both the first and second components. In such embodiments, the third component may be a different color than both the first component and the second component. For example, in certain embodiments, the three-lobed monofilament bristle 251 of FIG. 3A may have the first lobe 263*a* formed by a first component and being a first color, a second lobe 263*b* formed by a second component and being a second color, and the third lobe 263*c* formed by a third component and being a third color, with the first, second, and third colors all being different colors.

Figure 4:
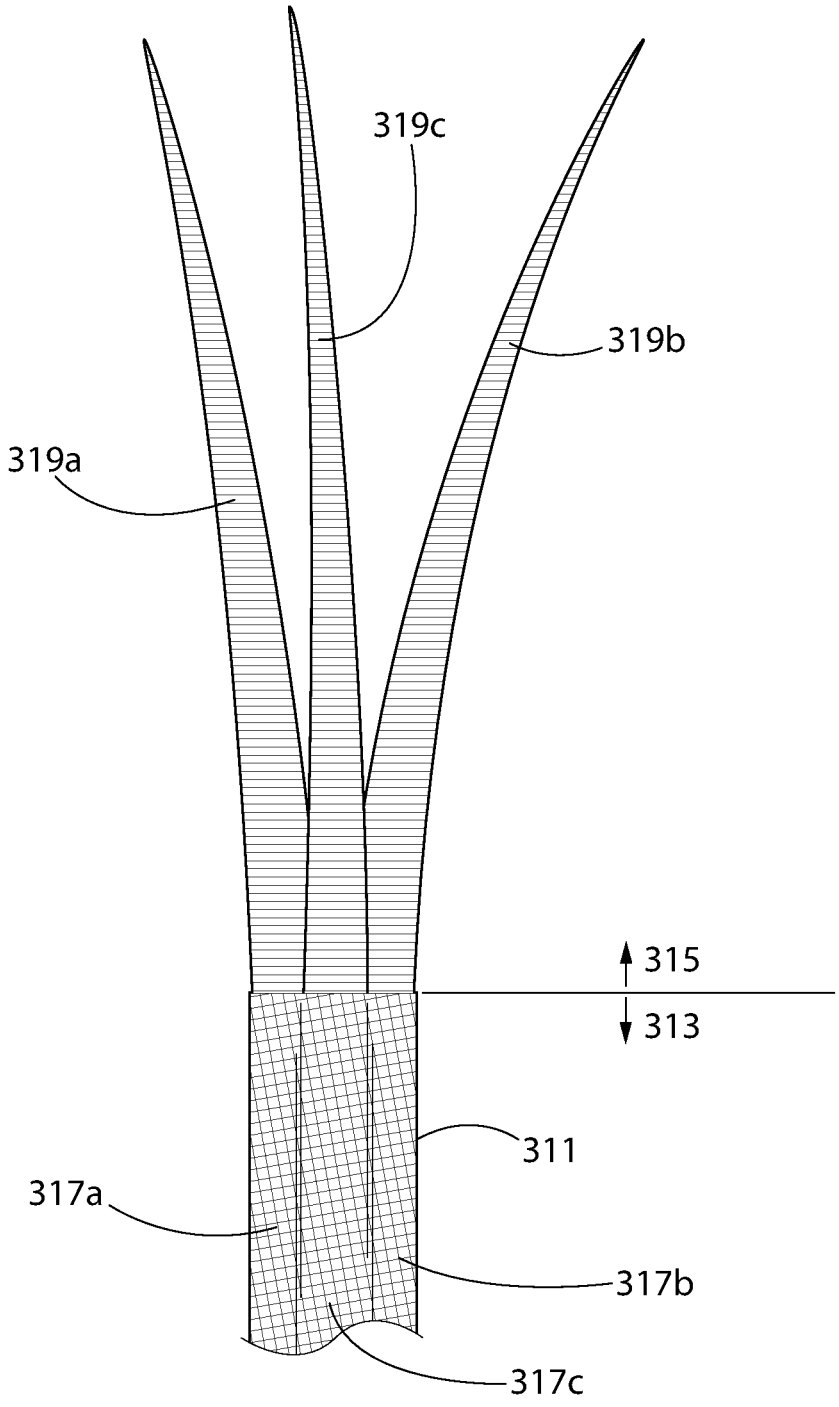
FIG. 4 illustrates a tip portion of a third monofilament bristle.

A top part of a monofilament bristle 311 is shown in FIG. 4. The body portion 313 of this monofilament bristle 311 has a multi-lobed transverse cross section, which includes three lobes, and a tip portion 315 extends from the body portion 313. The body portion 313 includes three lobes 317*a*, 317*b*, 317*c*, and the tip portion 315 includes three tips 319*a*, 319*b*, 319*c*, with each of the tips 319*a*, 319*b*, 319*c* extending longitudinally from, respectively, one of the three lobes 317*a*, 317*b*, 317*c*. In this embodiment, the outer surface of the body portion 313 may be a first color, and the outer surface of the tips 319*a*, 319*b*, 319*c* may be a second color, with the first color being different from the second color. This coloration difference may be formed, in certain embodiments, by dying the tip portion 315 after it has been formed by immersion in the chemical solution, and in certain other embodiments, by forming a core of the monofilament bristle 311 from a component having a different color than an outer sheath of the monofilament bristle 311.

Figure 5A:
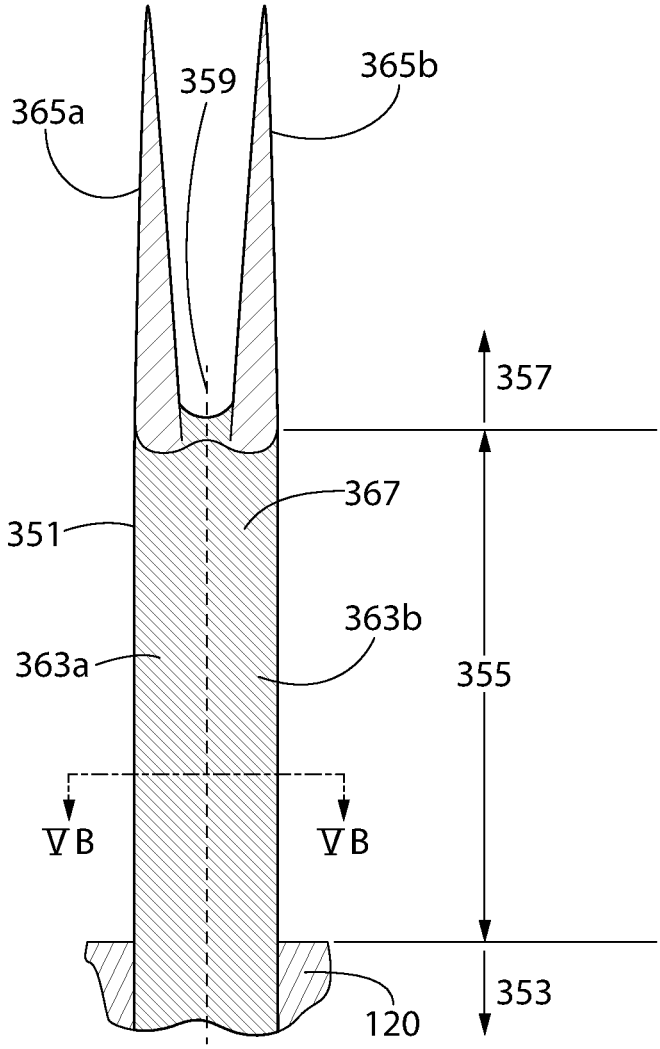
FIG. 5A illustrates a fourth monofilament bristle.
Figure 5B:
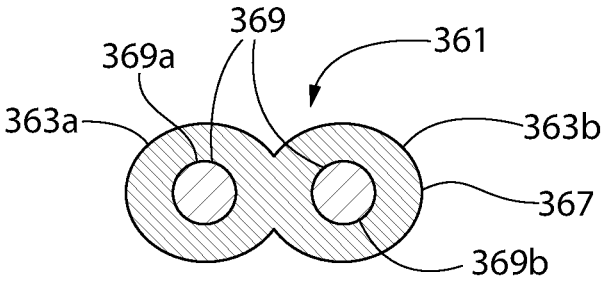
FIG. 5B illustrates a transverse cross-section of the body portion of the monofilament bristle of FIG. 5A.

Referring to both FIGS. 5A-5B, an embodiment of a monofilament bristle 351 is shown including an anchor portion 353, which extends into the head 120 and serves to anchor the monofilament bristle 351 to the head 120, a body portion 355, and a tip portion 357. The body portion 355 is located between the anchor portion 353 and the tip portion 357. The monofilament bristle 351 extends away from the head 120 along a longitudinal axis 359 and has a multi-lobed cross section 361 within at least the body portion 355, as shown in FIG. 5B. Each lobe 363*a*, 363*b* of the body portion 355 extends generally parallel to the longitudinal axis 359. In the embodiment shown in FIG. 5A, the tip portion 357 includes two tips 365*a*, 365*b*, with each tip 365*a*, 365*b* extending longitudinally from, respectively, one of the lobes 363*a*, 363*b* of the body portion 355. In certain embodiments, any one of the lobes 363*a*, 363*b* may terminate in more than one tip.

The monofilament bristle 351 may be formed by coextruding first and second components, with the first component forming sheath 367 of both lobes 363*a*, 363*b* of the body portion 355 and the second component forming a core 369 of the body portion 355. One or both of the first and second components may have coloring agents added, and one or both of the first and second components may be selected to vary in translucency/opaqueness. By varying the color of one or both of the first and second components, for example, in certain embodiments the outer surface of the tips 365*a*, 365*b* may be a different color than the outer surface of the sheath 367 after the tips 365*a*, 365*b* are formed by immersion of an end of the monofilament bristle 351 in a chemical solution, as described above.

Although the lobes shown in FIG. 5A have rounded surfaces, certain embodiments of the monofilament bristle 351 may include lobes with surfaces that are more rounded, less rounded, and even formed by a plurality of straight lines intersecting at angles. Further, although the core 369 of the body portion 355 is shown as being formed of two separate core sections 369*a*, 369*b*, one in each lobe 363*a*, 363*b*, in certain embodiments, the core 369 may have any number of core sections, each core section having any shape of cross section, and each core section effectively being a separate and independent core of the monofilament bristle 351. For example, a core section may have a cross section that is an oval, a simple polygon, a complex polygon, or an irregular polygon, among other various shapes. The use of different shapes may impart different coloration patterns on the tips 365*a*, 365*b*.

In certain embodiments, the core 369 of FIG. 5B, which is formed of the two separate core sections 369*a*, 369*b*, may have each of the separate core sections 369*a*, 369*b* formed from different components, each of the different components having different respective coloring agents, so that each core section 369*a*, 369*b* has a color that is different from the other. In still further embodiments, the color of each core section 369*a*, 369*b* may also be different from the color of the sheath 367 of the body portion 367. The translucency/opaqueness of each core section 369*a*, 369*b* may also be independently varied. In certain embodiments, the monofilament bristle 351 may be formed with more than two lobes and more than two core sections.

Figure 6A:
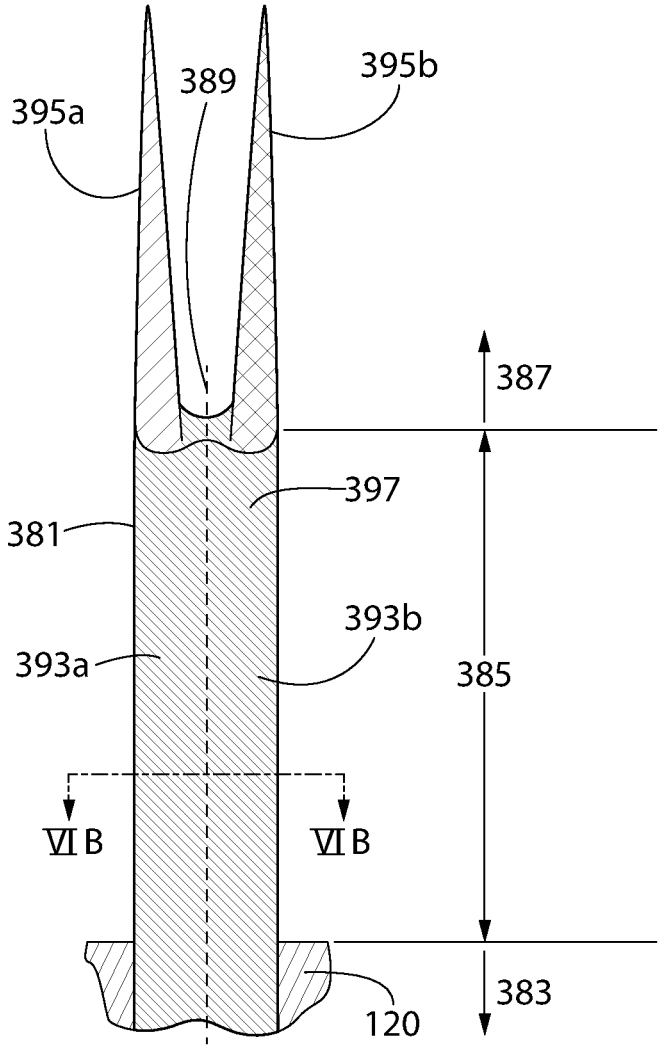
FIG. 6A illustrates a fourth monofilament bristle.
Figure 6B:
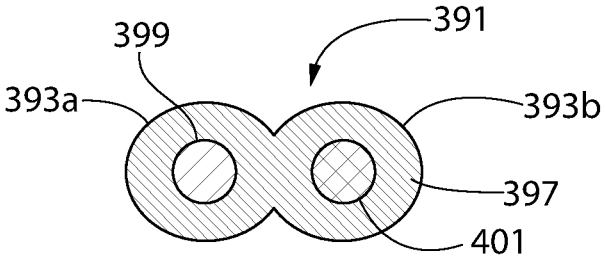
FIG. 6B illustrates a transverse cross-section of the body portion of the monofilament bristle of FIG. 6A.

Referring to both FIGS. 6A-6B, an embodiment of a monofilament bristle 381 is shown including an anchor portion 383, which extends into the head 120 and serves to anchor the monofilament bristle 381 to the head 120, a body portion 385, and a tip portion 387. The body portion 385 is located between the anchor portion 383 and the tip portion 387. The monofilament bristle 381 extends away from the head 120 along a longitudinal axis 389 and has a multi-lobed cross section 391 within at least the body portion 385, as shown in FIG. 6B. Each lobe 393*a*, 393*b* of the body portion 385 extends generally parallel to the longitudinal axis 389. In the embodiment shown in FIG. 6A, the tip portion 387 includes two tips 395*a*, 395*b*, with each tip 395*a*, 395*b* extending longitudinally from, respectively, one of the lobes 393*a*, 393*b* of the body portion 385. In certain embodiments, any one of the lobes 393*a*, 393*b* may terminate in more than one tip.

The monofilament bristle 381 may be formed by coextruding first, second, and third components, with the first component forming sheath 397 of both lobes 393*a*, 393*b* of the body portion 385, the second component forming a first core 399 of the body portion 385, and the third component forming a second core 401 of the body portion. In this embodiment, at least two of the first, second, and third components may have coloring agents added, so that each of the first, second, and third components are of a different color. In addition, any one or more of the first, second, and third components may be selected to vary in translucency/opaqueness. By varying the color of the first, second, and third components, in certain embodiments the outer surface of the tips 395*a*, 395*b* may be a different color than the outer surface of the sheath 397, after the tips 395*a*, 395*b* are formed by immersion of an end of the monofilament bristle 381 in a chemical solution, as described above, and in addition, the outer surface of the tips 395*a*, 395*b* may be different colors from each other.

Although the lobes shown in FIG. 6A have rounded surfaces, certain embodiments of the monofilament bristle 381 may include lobes with surfaces that are more rounded, less rounded, and even formed by a plurality of straight lines intersecting at angles. Further, each core 399, 401 of the body portion 385 may have any shape of cross section. Moreover, the shape of the cross section of each core 399, 401 may be different from the shape of cross section of the other core 399, 401. For example, each core 399, 401 may have a cross section that is an oval, a simple polygon, a complex polygon, or an irregular polygon, among other various shapes. The use of different shapes may impart different coloration patterns on the tips 395*a*, 395*b*.

Figure 7:
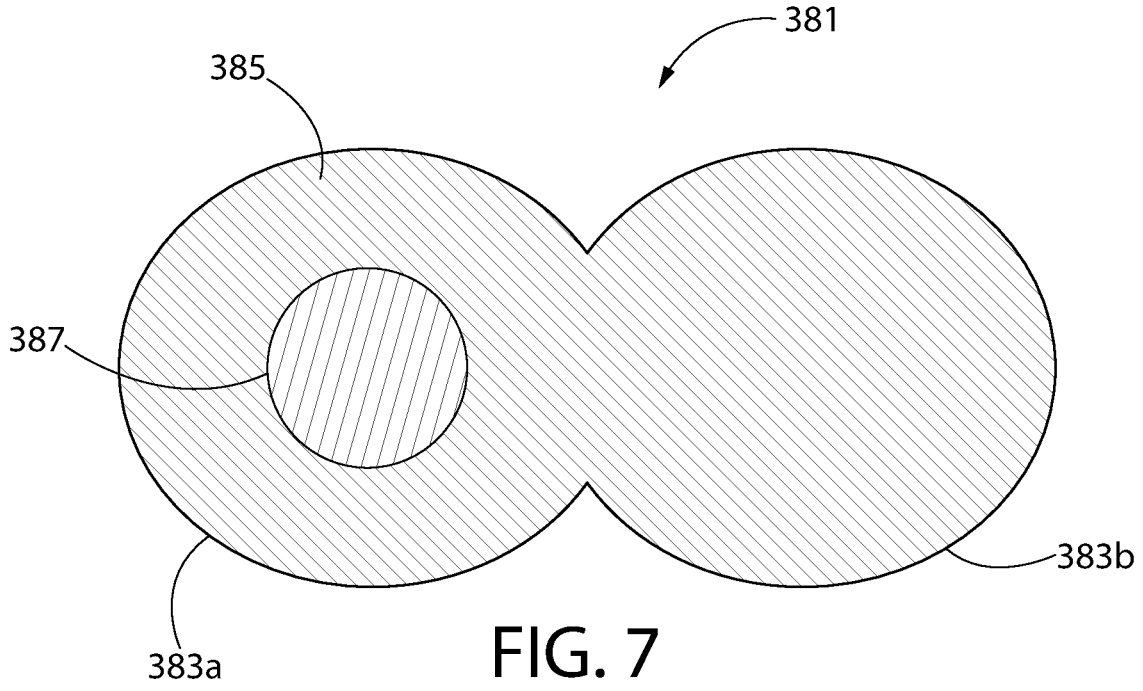
FIG. 7 illustrates a first alternative transverse cross section for a monofilament bristle.

An alternative embodiment of a cross section 381 for the body portion of a monofilament bristle is shown in FIG. 7. This cross section 381 of the body portion includes two lobes 383*a*, 383*b*, with a sheath 385 forming the outer surface of the two lobes 383*a*, 383*b*. The first lobe 383*a* has a separately defined core 387, while the second lobe 383*b* does not have a separately defined core. In a monofilament bristle having this type of cross section, the sheath 385 would be formed of a first component, while the core 387 would be formed of a second component. In certain embodiments, the first component may have a first color, while the second component may have a second color. In a monofilament bristle having this type of cross section, with components having different colors, the tip portion might include two tips, each having a different color, with the body portion being one, but not both, of the two colors.

Figure 8:
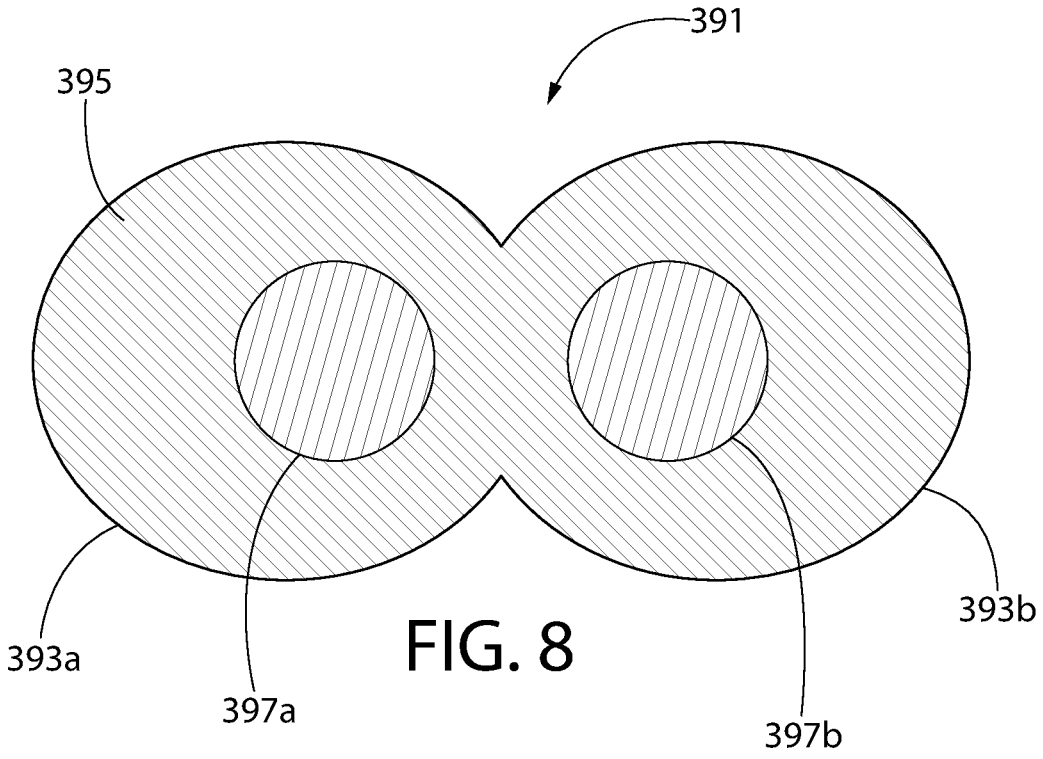
FIG. 8 illustrates a second alternative transverse cross section for a monofilament bristle.

Another alternative embodiment of a cross section 391 for the body portion of a monofilament bristle is shown in FIG. 8. This cross section 391 of the body portion includes two lobes 393*a*, 393*b*, with a sheath 395 forming the outer surface of the two lobes 393*a*, 393*b*. Each lobe 393*a*, 393*b* has a separately defined core 397*a*, 397*b*. In addition, each core 397*a*, 397*b* is positioned to be off center with respect to each lobe 393*a*, 393*b*. In a monofilament bristle having this type of cross section, the sheath 395 might be formed of a first component, while the core 397*a*, 397*b* might be formed of a second component. In a monofilament bristle having this type of cross section, the tip portion might include two tips, each tip having an outer surface of two colors, one being the color of the first component of the sheath 395, and the other the color of the second component of the core 397*a*, 397*b*. In certain embodiments, the one part of the core 397*a* might be formed of a second component, while the other part of the core 397*b* might be formed of a third component, with each of the second and third components having a color that is different from each other and different from the color of the first component.

Figure 9:
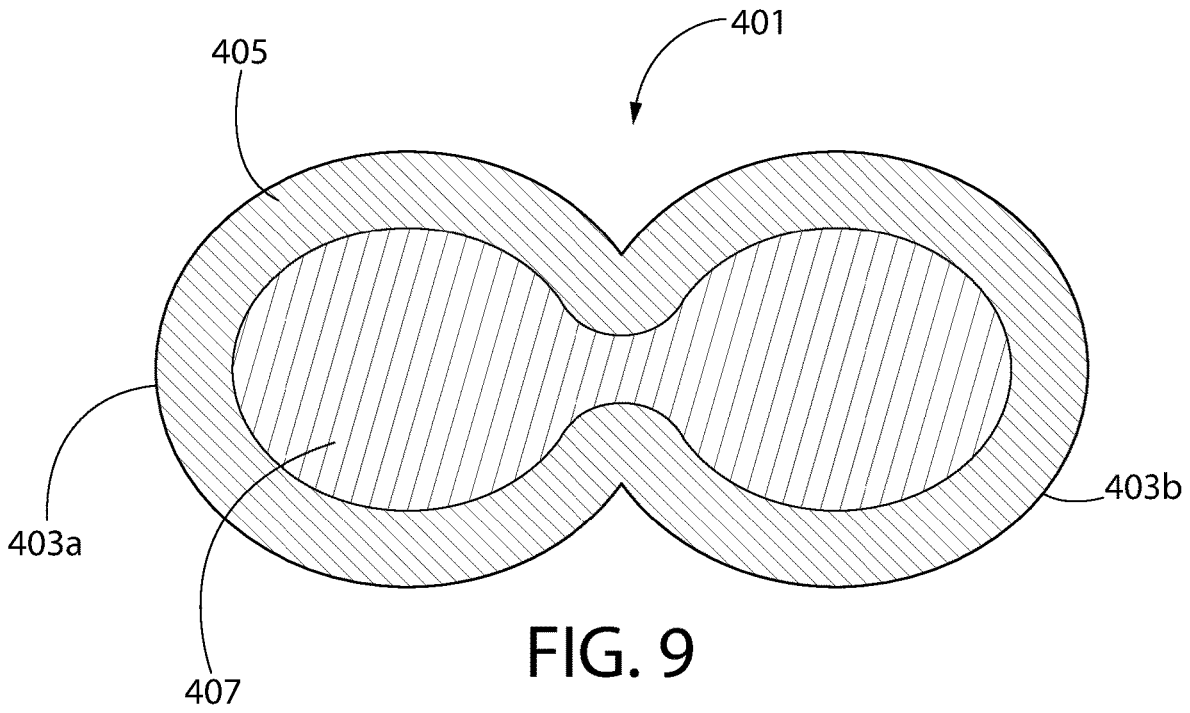
FIG. 9 illustrates a third alternative transverse cross section for a monofilament bristle.

Another alternative embodiment of a cross section 401 for the body portion of a monofilament bristle is shown in FIG. 9. This cross section 401 of the body portion includes two lobes 403*a*, 403*b*, with a sheath 405 forming the outer surface of the two lobes 403*a*, 403*b*. The two lobes 403*a*, 403*b* share a common core 407 which extends between the two lobes 403*a*, 403*b*. In a monofilament bristle having this type of cross section, the sheath 405 would be formed of a first component, while the core 407 would be formed of a second component. In certain embodiments, the first component may have a first color, while the second component may have a second color. In a monofilament bristle having this type of cross section, with components having different colors, the tip portion might include two tips, each tip having an outer surface of two colors, one being the color of the first component of the sheath 405, and the other the color of the second component of the core 407.

Those of skill in the art will recognize that the concepts exhibited by the embodiments shown in FIGS. 6-9 may be extended into a monofilament bristle having a body portion with more than two lobes. In certain embodiments, concepts exhibited by the embodiments shown in FIGS. 6-9 may be combined.

Figure 10:
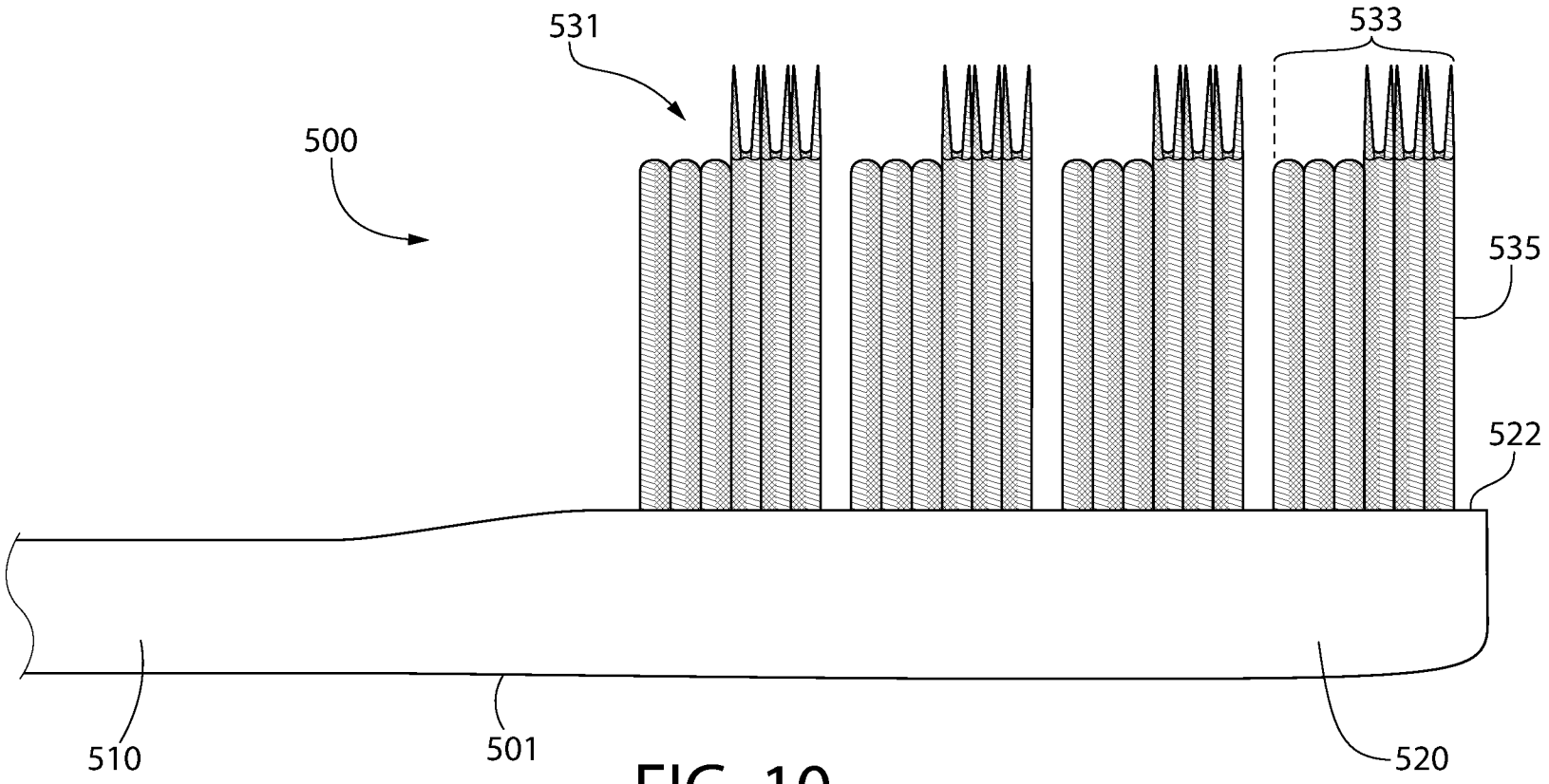
FIG. 10 illustrates a second oral care implement in accordance with an embodiment of the invention.

A second embodiment of an oral care implement 500 is illustrated in FIG. 10. Again, in this exemplified embodiment, the oral care implement 500 is in the form of a manual toothbrush. However, in certain other embodiments the oral care implement 500 can take on other forms such as a powered toothbrush. The oral care implement 500 generally includes a body 501 comprising a handle 510 and a head 520. In this embodiment, the head 520 of the oral care implement 500 is provided with a plurality of tooth cleaning elements 531 extending from the front surface 522. Furthermore, in this embodiment, the tooth cleaning elements 531 are illustrated as a plurality of bristle tufts 533, and each bristle tuft 533 is illustrated as a plurality of monofilament bristles 535. In certain embodiments the exact structure, pattern, orientation and material of the tooth cleaning elements 531 are not to be limiting of the present invention unless so specified in the claims. In certain embodiments, the tooth cleaning elements 531 may include the bristle tufts 533 along with one or more other types of tooth cleaning elements.

Figure 11:
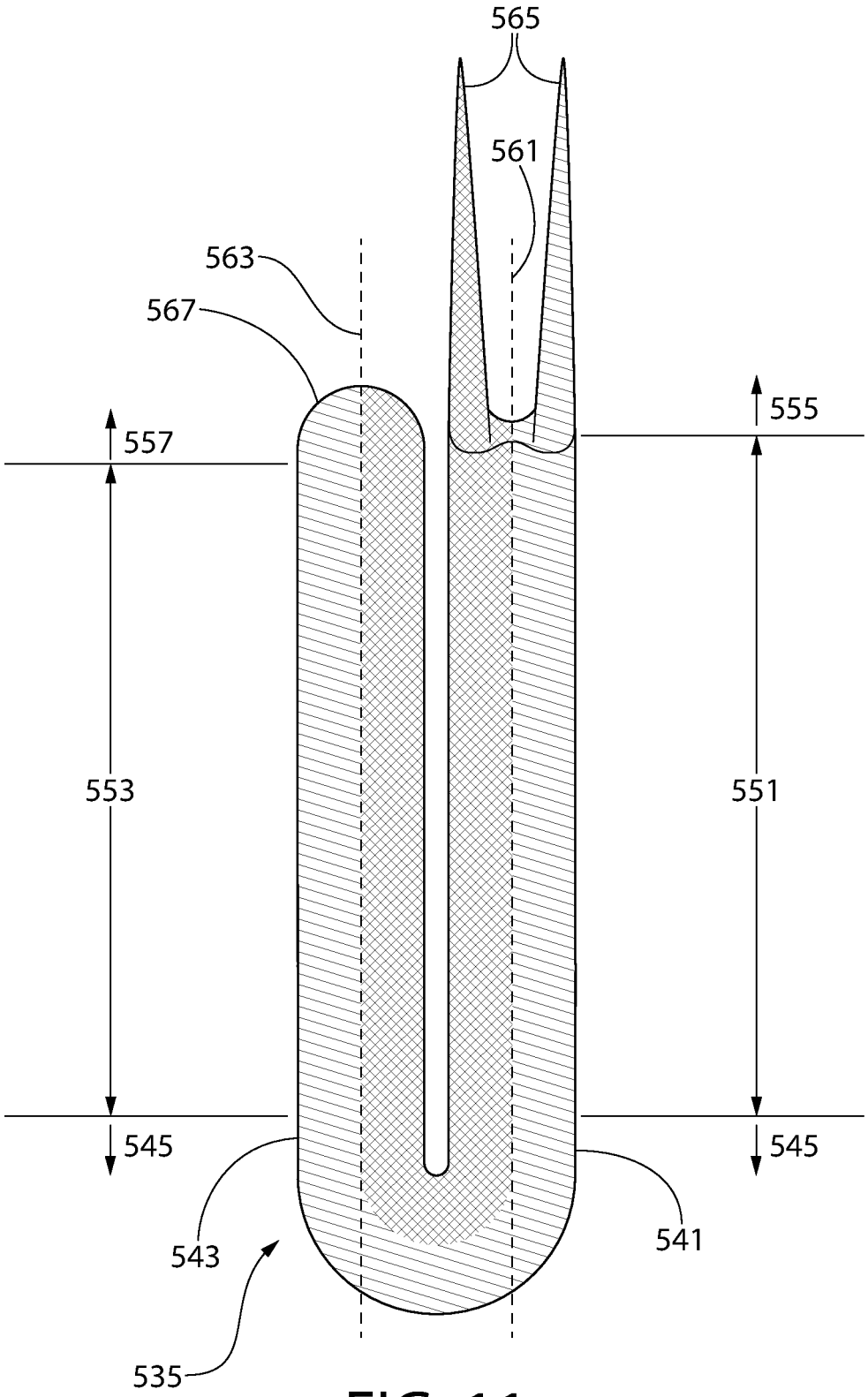
FIG. 11 illustrates a fifth monofilament bristle.

In the embodiment shown in FIG. 10, the bristle tufts 533 may be affixed to the head 520 by staples/anchors in a manner that is known in the art. In affixing the bristle tufts 533 in this manner, the monofilament bristles 535 which form each bristle tuft 533 may be bent into a U-shape, as shown in FIG. 11. Each U-shaped monofilament bristle 535 has two legs 541, 543 which extends away from the head 520 (FIG. 10). The legs 541, 543 share a common anchor portion 545, which is the bottom part of the U-shape that extends into the head 520 and is anchored to the head by the staple/anchor, a body portion 551, 553, and a tip portion 555, 557. The body portions 551, 553 are respectively located between the anchor portion 545 and the tip portions 555, 557, and each body portion 551, 553 extends away from the head 520 along a respective longitudinal axis 561, 563. In the embodiment depicted, the monofilament bristle 535 is bent into the U-shape so one of the legs 541 is longer than the other of the legs 543, so that the tips 565 of the tip portion 555 extend beyond the end-rounded tip 567 of the tip portion 557. In certain other embodiments the legs 541, 543 may be made of equal length, and in still other embodiments, the leg 541 may be shorter than the leg 543.

The at least the body portions 551, 553 of the monofilament bristle 535 have a multi-lobed cross section, such as any of those shown in FIGS. 2A-9, or any other configuration of cross section. The tip portion 555 may be formed with multiple tips 565 by immersing one end of the monofilament bristle 535 into a chemical solution, as described above, before the monofilament bristle 535 is bent into the U-shape. The tip portion 557 may be formed with a single end-rounded tip 567.

In certain embodiments, the monofilament bristle 535 may have a multi-lobed cross section formed using two or more components, each component forming at least one of the lobes, such as described above in connection with FIGS. 2A-2B and 3A-3B. In such embodiments, the two or more components may be different colors and form an interface in the central region of the body portion 551, where the lobes come together, the interface extending substantially parallel to the longitudinal axes 561, 563 in each of the body portions 551, 553.

In certain embodiments, the monofilament bristle 535 may have a multi-lobed cross section formed using two or more components, with one of the components forming a sheath in the body portions 551, 553, and another of the components forming a core in the body portions 551, 553, such as described above in connection with FIGS. 5A-5B and 6-9. In such embodiments, the two or more components may be different colors so that at least one of the tips 565 may have a color on the outer surface that is different from a color on the outer surface of the body portion 551. As discussed above, many different color combinations may be formed by altering the colors of the components, the geometries of the sheath and/or the core within a cross section of the body portion 551, and the relative spatial relationships of the sheath and the core within a cross section of the body portion 551.

What is claimed is:

1. A monofilament bristle comprising:

a body portion;

a tip portion, the monofilament bristle extending along a longitudinal axis;

the body portion having a multi-lobed transverse cross-section and having an outer surface that is a first color; and the tip portion comprising a plurality of tips extending axially from the body portion, at least a first one of the plurality of tips having an outer surface that is a second color, which is different from the first color.

2. The monofilament bristle of claim 1, wherein at least a second one of the plurality of tips comprises an outer surface that is a third color, which is different than each of the first and second colors.

3. The monofilament bristle of claim 1, wherein at least a second one of the plurality of tips comprises an outer surface that is the first color.

4. The monofilament bristle of claim 1 further comprising:

co-extruded first and second components;

wherein the first component is a sheath, the second component is a first core, and the sheath surrounds the first core in the body portion;

the sheath comprising the outer surface of the body portion that is the first color; and a portion of the first core that axially protrudes from the sheath forming the first one of the plurality of tips.

5. The monofilament bristle of claim 4 further comprising:

a third component that is a third color, which is different than each of the first and second colors, the third component being co-extruded with the first and second components;

the third component being a second core, and the sheath surrounding the second core in the body portion; and a portion of the second core that axially protrudes from the sheath forming a second one of the plurality of tips having an outer surface that is the third color.

* * * * *